United States Patent [19]

Grinberg

[11] Patent Number: 5,009,164

[45] Date of Patent: Apr. 23, 1991

[54] NON-PENETRATING PROJECTILE AND MEANS THEREFOR

[75] Inventor: Oded Grinberg, Mazkeret Batya, Israel

[73] Assignee: MNY Holdings and Agencies Limited, Tel-Aviv, Israel

[21] Appl. No.: 291,502

[22] Filed: Dec. 29, 1988

[30] Foreign Application Priority Data

Jan. 11, 1988 [IL] Israel ..... 85079

[51] Int. Cl.[5] ..... F42B 5/145; F42B 8/14; F42B 12/40

[52] U.S. Cl. ..... 102/502; 102/501; 102/513; 102/529

[58] Field of Search ..... 102/501, 502, 506, 513, 102/529

[56] References Cited

U.S. PATENT DOCUMENTS

| | | | |
|---|---|---|---|
| 3,782,286 | 1/1974 | Jones et al. | 102/502 |
| 3,791,303 | 2/1974 | Sweeney et al. | 102/502 |
| 3,865,038 | 2/1975 | Barr | 102/502 |
| 3,911,824 | 10/1975 | Barr et al. | 102/502 |
| 3,951,070 | 4/1976 | Flatau et al. | 102/502 |
| 3,980,023 | 9/1976 | Misevich | 102/502 |
| 4,262,597 | 4/1981 | Olson | 102/502 |
| 4,656,947 | 4/1987 | Gordon et al. | 102/502 |
| 4,682,546 | 7/1987 | Chovich | 102/529 |

FOREIGN PATENT DOCUMENTS

| | | |
|---|---|---|
| 1232616 | 10/1968 | United Kingdom . |
| 1260105 | 6/1970 | United Kingdom . |
| 1382860 | 8/1972 | United Kingdom . |
| 1439263 | 11/1973 | United Kingdom . |
| 1561743 | 8/1976 | United Kingdom . |
| 2125524 | 8/1983 | United Kingdom . |
| 2188129 | 3/1986 | United Kingdom . |

*Primary Examiner*—David H. Brown

*Attorney, Agent, or Firm*—Kane, Dalsimer, Sullivan, Kurucz, Levy, Eisele and Richard

[57] ABSTRACT

A projectile is described, which changes its shape upon impact on a target and thereby reduces the danger of penetration into a living target. The projectile is useful for the identification of individuals in crowds, by filling it with staining material which stains the target upon impact, and may further contain other liquid or gaseous materials, such as tear gas. The projectile of the invention is further useful for different uses, such as for gunfight simulation.

14 Claims, 3 Drawing Sheets

NON-PENETRATING PROJECTILE AND MEANS THEREFOR

THE FIELD OF THE INVENTION

The present invention relates, in general, to apparatus for maintaining public order and to military training apparatus and, in particular, to ammunition for light weapons.

BACKGROUND OF THE INVENTION

There are known different means for dispersal, by military or police units, of persons illegally gathered. Among these means are live ammunition, water cannon, tear gas and rubber bullets.

As it is usually an aim to disperse such gatherings and subsequently to arrest some or all of the persons involved, none of the above-listed means is effective. The use of live ammunition may cause serious injury and sometimes fatalities. The use of water cannon, tear gas and rubber bullets is effective in causing dispersal of illegal gatherings, and usually causes a minimum of injuries, but subsequent identification of involved persons is very difficult, especially when disguises, such as face-coverings, are worn by them.

A further method used for dispersal of persons illegally gathered, and which also facilitates subsequent identification of the persons involved is the use of water cannon in which the liquid directed at the persons includes a color dye. A disadvantage of using this type of water cannon is that it is difficult to direct the water cannon at only a few persons wanted for detention and who are mixed in with a large crowd of persons without spraying at least a few persons in the crowd who are not required for detention.

In the area of military training, it is often useful to carry out gunfight simulations. When live ammunition is not, however, used, due to the wish to avoid casualties among the participants in such simulations, and "blanks" are used instead, the usefulness of the simulations may be limited. It is appreciated that a way to determine gunfire accuracy is to observe the number and location of the hits scored. When blanks are used, such observation is not possible.

SUMMARY OF THE INVENTION

It is a purpose of the present invention to provide a projectile which changes its shape upon impact on a target and thereby reduces the danger of penetration into a living target.

It is a further purpose of the invention to provide an effective means of crowd dispersal which causes a minimum of injury and aids in the subsequent identification of involved persons.

It is an additional purpose of the invention to provide means for the identification of individuals in crowds.

It is yet a further purpose of the invention to provide non-live ammunition that is useful for gunfight simulation and which facilitates observations of hits scored on a target.

In accordance with an embodiment of the invention there is provided, therefore, a projectile, adapted to impact upon surface, comprising a housing defining a sealed chamber containing a substance and adapted to discharge the substance when impacting upon the surface.

Additionally in accordance with an embodiment of the invention the projectile has an elongated configuration and is internally divided into a plurality of sealed chambers.

Further in accordance with an embodiment of the invention the substance is a staining substance.

Additionally in accordance with an embodiment of the invention the housing comprises a plurality of walls of a first thickness which include a plurality of portions of a second thickness thinner than the first thickness located such that when the projectile impacts upon the surface, the walls fracture at the second thickness wall portions thereby to cause discharge of the substance from the chambers.

Further in accordance with an embodiment of the invention, the projectile is adapted for firing from a gun, and also comprises an elongated shell into which the housing is adapted to be at least partially inserted; explosive material contained within the shell; and a detonator, associated with a base of the shell, adapted to explode the explosive material, thereby causing expulsion of the elongated housing from the shell. The charge contained in the shell should of course be such that the impact force imparted to the projectile is not sufficient to cause substantial penetration of the projectile or of parts thereof into a live target.

In accordance with an alternative embodiment of the invention there is provided apparatus for impacting onto a target, comprising a projectile comprising a housing defining a sealed chamber containing a substance and adapted to discharge the substance when impacting upon the surface and means for containing a plurality of the projectiles.

Additionally in accordance with an embodiment of the invention, the means for containing a plurality of the projectiles comprises a container adapted to be mounted on a gun and to permit simultaneous expulsion of said plurality of said projectiles therefrom.

In accordance with an alternative embodiment of the invention, the projectile has a bullet configuration and the housing for a plurality of the projectiles comprises a bullet magazine configured for restricting the insertion thereinto of live ammunition.

BRIEF DESCRIPTION OF THE DRAWINGS

The present invention will be understood and appreciated more fully from the following detailed description taken in conjunction with the drawings, in which.

DETAILED DESCRIPTION OF THE INVENTION

Figure 2B:
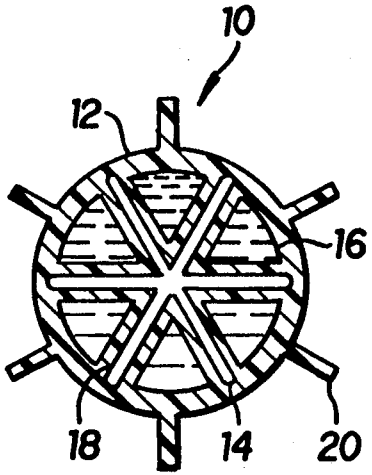
FIGS. 2A and 2B are cross-sections taken, respectively, along lines A—A and B—B in FIG. 1.
Figure 1:
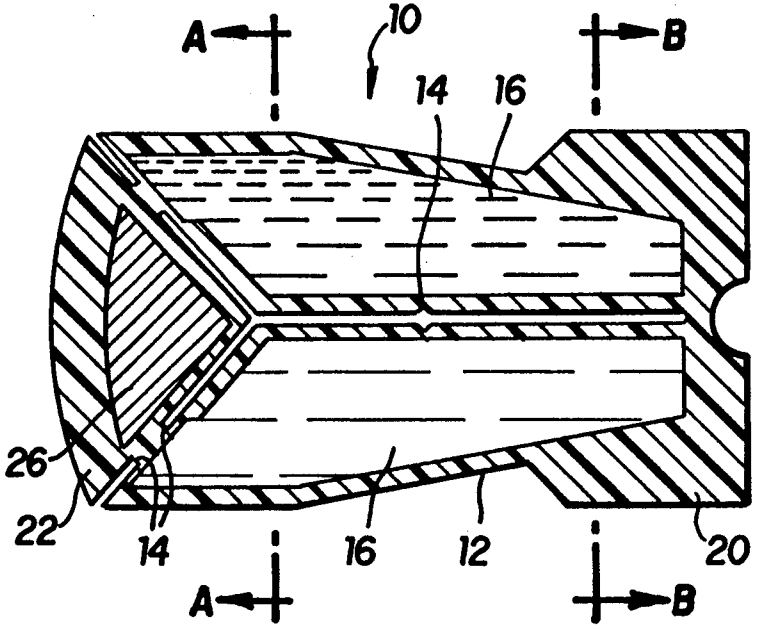
FIG. 1 is a cross-section of a projectile according to a preferred embodiment of the invention.
Figure 2A:
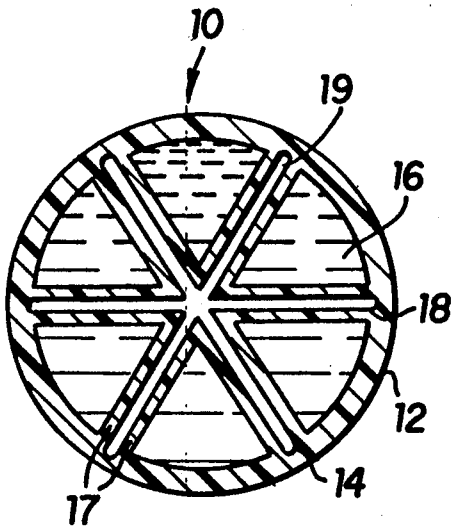

Referring to FIGS. 1, 2A and 2B, there is indicated generally by reference numeral 10 a projectile, according to a preferred embodiment of the present invention. Projectile 10 is adapted to be fired by suitable means, such as a light weapon that is adapted to fire rubber bullets, such that upon impacting upon a person, for example, it releases a liquid dye or other substance which stains the skin and clothing of the person and facilitates his subsequent identification.

Projectile 10 comprises a housing 12 made preferably from plastic or rubber and each wall portion thereof has a generally uniform thickness except at locations 14 where the thickness of the wall is greatly reduced. Housing 12 defines a space that is longitudinally subdivided by internal walls 18 into a plurality of compartments 16. Each wall 18 is a double wall made from two leaves 17 separated by a gap 19.

Each compartment 16 contains a liquid staining substance which, according to one embodiment of the invention, is mixed with a liquefied form of tear gas. There is also provided a plurality of fins 20 that aid in maintaining a flight path once the projectile has been fired.

It will be appreciated by person skilled in the art that projectile 10 is divided into compartments so as to reduce the potentially deleterious effect, on the flight path of the projectile, of shock waves caused by initial acceleration thereof which would reverberate freely inside an undivided volume of liquid, in the case that the projectile contains a liquid.

The nose 22 of projectile 10 has, according to one embodiment of the invention, a weight 26 implanted therein so as to enhance the ballistic characteristics of the projectile and in order to increase the force at which it impacts upon a surface.

After having been fired from any appropriate means, when projectile 10 impacts upon a person, for example, a relatively large force is required to bring it to rest. Nose 22, which constitutes the leading end of the projectile is, however, blunt and the impact force is, therefore, not sufficient to cause the projectile to penetrate a person's body.

Figure 3:
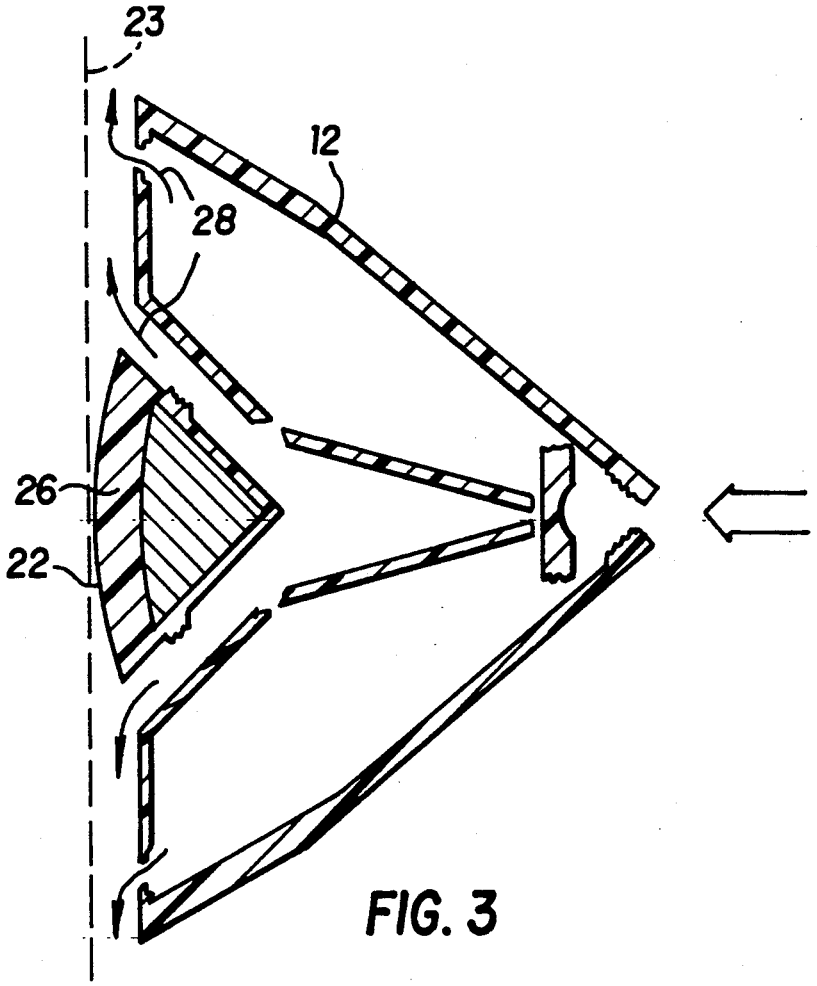
FIG. 3 is a schematic representation showing the projectile of FIG. 1 impacting upon a surface.

With additional reference to FIG. 3, it will be appreciated that an additional factor which prevents the penetration of the projectile into a person's body is the breakup of the projectile as it impacts upon a surface 23, which causes the spreading of the impact force. Break up occurs as the impact force causes the walls of the projectile to fracture at reduced wall thickness locations 14 and, in addition to releasing a liquid, if contained therein, as shown schematically by arrows 28, and thereby to stain surface 23, the impact force is spread over an increasingly large area.

Figure 4:
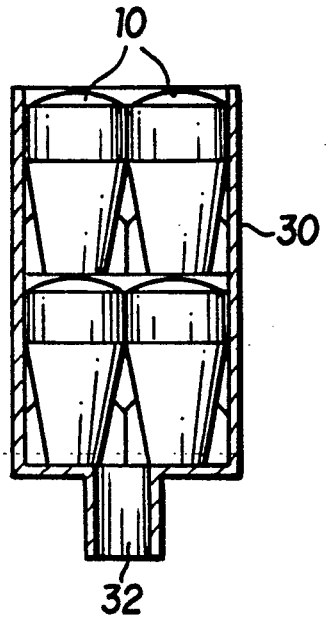
FIG. 4 is a schematic cut-away illustration of a loaded projectile housing, according to a preferred embodiment of the invention.

Referring additionally to FIG. 4, according to a preferred embodiment of the invention a plurality of projectiles 10 may be fired simultaneously. This is achieved by providing a housing 30 in which the projectiles are arranged. An end 32 of the housing is adapted to be loaded into an appropriate firing device and, when the device is fired, the projectiles are simultaneously propelled away from the housing.

Figure 6B:
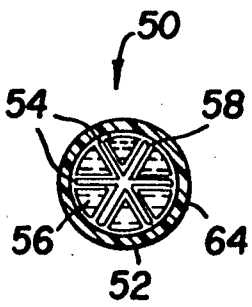
FIGS. 6A and 6B are cross-sections taken, respectively, in the direction of arrow A and along line B—B in FIG. 5.
Figure 5:
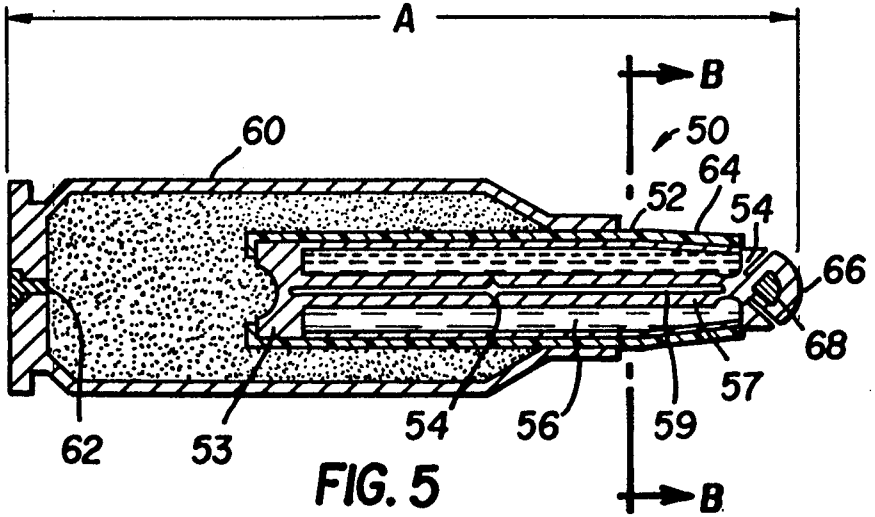
FIG. 5 is a cross-section of a projectile according to an alternative embodiment of the invention.
Figure 6A:
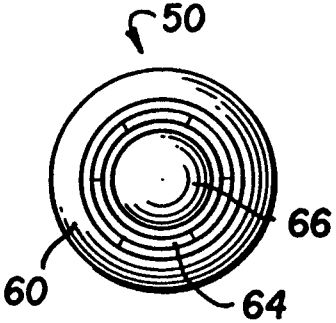

Referring to FIGS. 5, 6A and 6B there is shown a projectile 50, designed and constructed in accordance with an alternative embodiment of the invention. Projectile 50 has a bullet configuration and is adapted to be fired by any suitable light weapon.

Projectile 50 comprises an elongated housing 52 made preferably from plastic or rubber and each wall portion thereof has a generally uniform thickness except at locations 54 where the thickness of the wall is greatly reduced. Housing 52 defines a space that is subdivided by internal walls 58 into a plurality of compartments 56 containing a liquid staining substance. Each wall 58 is a double wall made from two leaves 57 separated by a gap 59.

It will be appreciated by persons skilled in the art that projectile 50 is divided into compartments so as to reduce the potentially deleterious effect, on the flight path of the projectile, of shock waves caused by initial acceleration thereof which would reverberate freely inside an undivided volume of liquid, in the case that the projectile contains a liquid.

Projectile 50 is retained in a conventional bullet shell 60 in the base of which is included a detonator 62 which is adapted to cause explosion of explosive material contained within shell 60 for propulsion of projectile 50. Projectile housing 52 is formed with a thickened base 53 so as to withstand the force of the explosion.

In accordance with an embodiment of the invention, a segmented, typically metal, skin 64 is provided about the projectile so as to prevent breakup thereof while travelling through a gun barrel and also to reduce friction, between the projectile and the gun barrel, upon firing of the projectile. Once the projectile has been fired and leaves the gun barrel, skin 64 falls away therefrom.

A nose 66 of projectile 50 has, according to one embodiment of the invention, a weight 68 implanted therein so as to enhance the ballistic characteristics of the projectile and in order to increase the force at which it impacts upon a surface.

After having been fired from any appropriate means, when projectile 50 impacts upon a person, for example, a relatively large force is required to bring it to rest. Nose 66, which constitutes the leading end of the projectile is, however, blunt and the impact force is, therefore, not sufficient to cause the projectile to penetrate a person's skin.

As with projectile 10, shown impacting upon a surface 23 in FIG. 3, it will be appreciated that an additional factor which prevents the penetration of projectile 50 into a person's body is the breakup of the projectile as it impacts upon a surface which causes the spreading of the impact force. Break up occurs as the impact force causes the walls of the projectile to fracture at reduced wall thickness locations 54 and, in addition to releasing a liquid, if contained therein, and thereby to stain the surface, the impact force is spread over an increasingly large area.

It will be appreciated by persons skilled in the art that although a liquid staining substance has been described in relation to both projectiles 10 and 50, this is not intended to preclude the use of a non-liquid substance in conjunction with therewith, or the absence of an added substance, and the chambers may be filled only with air.

Figure 7:
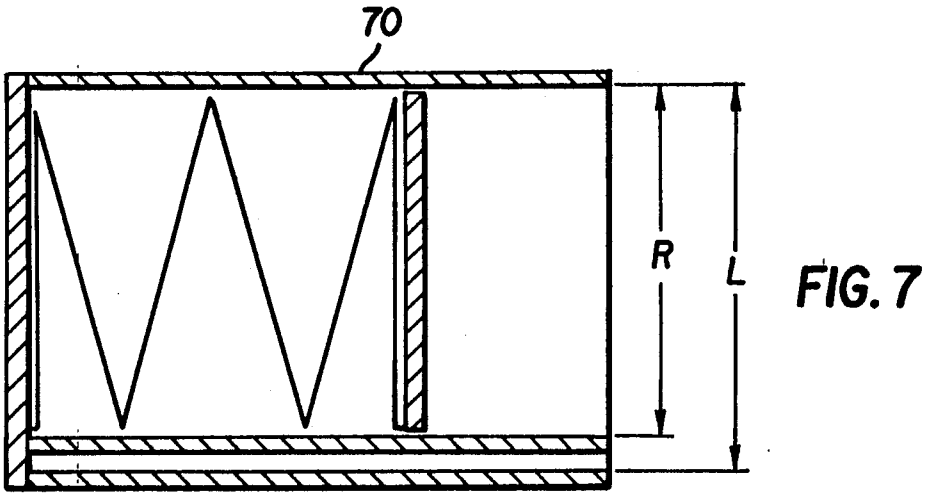
FIG. 7 is a cut away partial view of a magazine used in conjunction with the projectile of FIG. 5.

Referring to FIG. 7 there is shown a bullet magazine 70 that is of a sort typically used in conjunction with conventional bullets for light weapons. It is known in the art for a bullet magazine to be made for a specific gun or rifle and, in order to prevent a magazine provided for projectiles 50 from being used for live ammunition, magazine 70 is formed with an internal width "R", which is sufficient for projectiles 50 to be loaded thereinto but which is too short for a standard live bullet, of length "L", generally used with a gun for which magazine 70 is intended to be used, to be loaded thereinto.

In accordance with an embodiment of the invention, magazine 70 is adapted to be further distinguished from a similar magazine, intended to carry live bullets, by means of external surface markings.

It should be further appreciated that the position of the reduced wall thickness locations, e.g. 14 in FIG. 1, may be varied thus changing the dimension of the nose 22. This may be important to reduce the hazard of bullet penetration, and should be specifically devised by the skilled engineer for each embodiment.

It will be appreciated by persons skilled in the art that the present invention is not limited by what has been shown and described above. Many structural modifications and different shapes of the projectile can be provided, without exceeding the scope of the invention.

I claim:

1. A projectile for impact upon a surface, comprising a housing defining at least two substantially sealed chambers wherein said housing comprises a plurality of walls of a first thickness which include a plurality of portions of a second thickness thinner than said first thickness, at least one of said walls being of a double leaf construction, said second thickness portions being located on said wall in order to provide points of stress which will fracture when the projectile impacts with a surface.

2. A projectile according to claim 1, wherein the placement of the second thickness portions is such that the fracture causes the impact force to be spread over a large area.

3. A projectile according to claim 1, wherein said housing has an elongated configuration.

4. A projectile according to claim 1 wherein the chambers contain a substance, and the projectile is adapted to discharge said substance when the walls fracture at the second thickness wall portion upon impact with a surface.

5. A projectile according to claim 4, wherein said substance is a dry, powdery substance.

6. A projectile according to claim 4, wherein said substance is a staining substance.

7. A projectile according to claim 6, wherein the staining substance comprises a liquid.

8. A projectile according to claim 7, and wherein said liquid also includes a liquid form of tear gas.

9. A projectile according to any of the preceding claims, and wherein a front end portion of said projectile comprises a nose portion in which there is implanted a weight.

10. A projectile according to claim 3, and wherein said elongated housing includes a plurality of externally mounted radially extending fins.

11. A projectile according to claim 1, and wherein said projectile is adapted for firing from a gun, said projectile also comprising;

an elongated shell into which said housing is adapted to be at least partially inserted;

explosive material contained within said shell; and a detonator associated with a base of said shell, adapted to explode said explosive material, thereby causing expulsion of said elongated housing from said shell.

12. A projectile according to claim 11, and wherein said projectile also includes a low-friction skin surrounding at least part of said housing so as to prevent breakup thereof while being fired from the gun, said skin being mounted onto said housing such that it becomes detached therefrom after said housing is expelled from the gun barrel.

13. A projectile according to claim 12, and wherein said skin comprises a plurality of segments.

14. An ammunition device comprising at least one projectile and means for containing the projectile, the projectile adapted to impact upon a surface, comprising a housing defining at least two substantially sealed chambers wherein said housing comprises a plurality of walls of a first thickness which include a plurality of portions of a second thickness thinner than said first thickness at least one of said walls being of a double leaf construction.

* * * * *